US007658382B2

(12) United States Patent
Terada

(10) Patent No.: US 7,658,382 B2
(45) Date of Patent: Feb. 9, 2010

(54) IMAGE RECORDING APPARATUS THAT SUPPORTS CONVEYING ROLLER VIA ROLLING BEARING

(75) Inventor: Kohei Terada, Nagoya (JP)

(73) Assignee: Brother Kogyo Kabushiki Kaisha, Nagoya-Shi (JP)

( * ) Notice: Subject to any disclaimer, the term of this patent is extended or adjusted under 35 U.S.C. 154(b) by 236 days.

(21) Appl. No.: 11/541,053

(22) Filed: Sep. 29, 2006

(65) Prior Publication Data

US 2007/0077080 A1 Apr. 5, 2007

(30) Foreign Application Priority Data

Sep. 29, 2005 (JP) ..... 2005-283273

(51) Int. Cl.
*B65H 5/02* (2006.01)

(52) U.S. Cl. ..... 271/274; 271/272; 271/273

(58) Field of Classification Search ..... 271/275, 271/314, 274, 273
See application file for complete search history.

(56) References Cited

U.S. PATENT DOCUMENTS

| | | | | |
|---|---|---|---|---|
| 4,000,943 | A * | 1/1977 | Bar-on | 399/203 |
| 4,256,299 | A * | 3/1981 | Hogenson | 271/262 |
| 4,402,497 | A * | 9/1983 | Weibel et al. | 271/11 |
| 4,611,939 | A * | 9/1986 | Fujiwara | 400/637 |
| 5,210,616 | A * | 5/1993 | Kawasaki et al. | 358/296 |
| 5,441,353 | A * | 8/1995 | Kim | 400/636.1 |
| 5,718,424 | A * | 2/1998 | Nakatani et al. | 271/121 |
| 5,957,599 | A | 9/1999 | Yamada | |
| 6,371,481 | B1 * | 4/2002 | Miyake | 271/314 |
| 6,817,611 | B2 * | 11/2004 | DiRamio | 271/273 |
| 6,820,873 | B2 * | 11/2004 | Kulpa | 271/273 |
| 2005/0225029 | A1 * | 10/2005 | Kawashima | 271/274 |
| 2007/0145678 | A1 * | 6/2007 | Terada | 271/272 |
| 2007/0145679 | A1 * | 6/2007 | Terada | 271/272 |
| 2007/0228642 | A1 * | 10/2007 | Terada | 271/109 |
| 2008/0136097 | A1 * | 6/2008 | Huang | 271/314 |

FOREIGN PATENT DOCUMENTS

| | | |
|---|---|---|
| JP | 2004168451 | 6/2004 |

* cited by examiner

*Primary Examiner*—Patrick H Mackey
*Assistant Examiner*—Howard Sanders
(74) *Attorney, Agent, or Firm*—Reed Smith LLP

(57) ABSTRACT

An image recording apparatus includes a casing, an image recording unit, a first conveying unit, a second conveying unit, a first support member, and a second support member. The first support member is supported by the casing. The second support member rotatably supports the follow roller and has an urging member that applies an urging force to the follow roller for urging the follow roller toward the drive roller. The second support member is supported on the first support member via a rolling bearing, allowing the second support member to rollingly move to a first position when the first conveying unit nippingly conveys the recording medium and allowing the second support member to rollingly move to a second position upstream of the first position in the conveying direction when the recording medium is separated from the first conveying unit.

10 Claims, 14 Drawing Sheets

IMAGE RECORDING APPARATUS THAT SUPPORTS CONVEYING ROLLER VIA ROLLING BEARING

CROSS REFERENCE TO RELATED APPLICATIONS

This application claims priority from Japanese Patent Application No. 2005-283273 filed Sep. 29, 2005. The entire content of the priority application is incorporated herein by reference.

TECHNICAL FIELD

The disclosure relates to an image recording apparatus for recording images on a sheet-like recording medium.

BACKGROUND

A conventional image recording apparatus includes a conveying unit having a drive roller and a follow roller in pressure contact with the drive roller for conveying a recording medium to an image recording position. The image recording apparatus has a platen for supporting the recording medium at the image recording position, a carriage that can be moved by sliding in a direction (main scanning direction) orthogonal to a conveying direction for conveying the recording medium (sub-scanning direction), and a recording head mounted in the carriage so as to confront the platen.

SUMMARY

FIGS. 1A through 1C show a portion of the internal structure in an inkjet type image recording apparatus having a platen 102 for supporting a recording paper S at an image recording position, a carriage 101 that can be moved by sliding in a direction (vertical direction in FIGS. 1A through 1C; hereinafter referred to as the "main scanning direction") orthogonal to a conveying direction for conveying the recording paper S (left-and-right direction in FIGS. 1A through 1C; hereinafter referred to as the "sub-scanning direction"), and a recording head 100 mounted in the carriage 101 so as to confront the platen 102. The image recording apparatus having this construction feeds a sheet of the recording paper S from a paper cassette (not shown) and conveys the sheet intermittently by predetermined steps, while the carriage 101 conveys the recording head 100 and the recording head 100 ejects ink from nozzles therein onto the recording paper S at times that the recording paper S is halted between intermittent conveying steps, thereby recording an image by predetermined regions.

A controller (not shown) controls the rotations of the conveying rollers 103 disposed upstream of the platen 102 in the paper-conveying direction (hereinafter abbreviated as the "upstream side") and the discharge rollers 104 disposed downstream of the platen 102 in the paper-conveying direction (hereinafter abbreviated as the "downstream side") in order to convey the recording paper S intermittently.

The conveying rollers 103 are configured of a drive roller 105 that is driven to rotate by a rotational force transmitted from a motor or the like, a follow roller 106, and coil springs 107 that urge the follow roller 106 to contact the drive roller 105 with pressure. When the leading edge of the recording paper S fed from the paper cassette arrives at the conveying rollers 103, as shown in FIG. 1A, the recording paper S becomes interposed between the drive roller 105 and the follow roller 106 and is conveyed forward by the conveying rollers 103. As the conveying rollers 103 convey the recording paper S farther, as shown in FIG. 1B, the discharge rollers 104 grip the leading edge of the recording paper S so that the recording paper S is now being conveyed by both the conveying rollers 103 and discharge rollers 104. As the recording paper S is conveyed farther, as shown in FIG. 1C, the trailing edge of the recording paper S separates from the conveying rollers 103, so that the recording paper S is conveyed only by the discharge rollers 104. Similarly, the discharge rollers 104 include a drive roller 108 and a follow roller 109. However, since the discharge rollers 104 pinch and convey the recording paper S after an image has been recorded thereon, the pressing force of the follow roller 109 is set less than that in the conveying rollers 103 to avoid degrading the image.

In the image recording apparatus having this construction, a component of pressure applied by the conveying rollers 103 at the nip part in a direction perpendicular to the recording paper S acts in the conveying direction of the recording paper S at the instant the trailing edge of the recording paper S leaves the conveying rollers 103. At this time, a force greater than the conveying force received from the rotating drive roller 105 acts on the trailing edge of the recording paper S causing the recording paper S to slip within the discharge rollers 104, which apply a smaller force of pressure, and jump a distance greater than the predetermined conveying amount. As a result, image displacement occurs on the recording paper S, degrading the image quality. This problem is particularly noticeable when recording images on glossy paper or the like that is relatively thick and has a greater stiffness.

Japanese Patent Application Publication No. 2004-168451 describes a recording device designed to overcome this problem. This recording device has a follow roller that is rotatably supported and capable of sliding in the conveying direction. The follow roller receives a reaction force from the paper when the leading edge of the paper comes out of the nip part between the drive roller and follow roller, causing the follow roller to retract toward the upstream side in the paper-conveying direction. More specifically, the rotational shaft of the follow roller in the recording device is slidably supported in elongated holes formed in a holder that extend in the conveying direction.

However, in the recording device described above, the follow roller is configured to move rearward as the rotational shaft of the follow roller slides in the elongated holes when a reaction force generated by the paper leaving the drive roller and follow roller acts on the follow roller. Hence, while smaller than the reaction force, a frictional force toward the downstream side in the conveying direction is produced by this sliding movement. Since this frictional force acts in a direction for pushing the paper, the paper is conveyed an amount greater than required. For today's image recording apparatus with increasingly higher resolutions, such excess conveyance invites a decline in image quality of a degree that cannot be tolerated.

In view of the foregoing, it is an object of the invention to provide an image recording apparatus capable of improving image quality by absorbing a force acting to push the trailing edge of a paper or other recording medium in the conveying direction when the recording medium separates from the nip part between the drive roller and follow roller in order to prevent the recording medium from being conveyed an excessive amount.

In order to attain the above and other objects, the invention provides an image recording apparatus. The image recording apparatus includes a casing, an image recording unit, a first conveying unit, a second conveying unit, a first support member, and a second support member. The image recording unit is disposed in the casing for recording an image on a recording medium at an image recording position. The first conveying unit has a drive roller and a follow roller in pressure contact with the drive roller. The first conveying unit conveys the recording medium in a conveying direction toward the image recording position. The second conveying unit is disposed downstream of the image recording position in the conveying direction. The second conveying unit conveys the recording medium farther in the conveying direction after the image recording unit records an image. The first support member is supported by the casing. The second support member rotatably supports the follow roller and has an urging member that applies an urging force to the follow roller for urging the follow roller toward the drive roller. The second support member is supported on the first support member via a rolling bearing, allowing the second support member to rollingly move to a first position when the first conveying unit nippingly conveys the recording medium and allowing the second support member to rollingly move to a second position upstream of the first position in the conveying direction when the recording medium is separated from the first conveying unit.

BRIEF DESCRIPTION OF THE DRAWINGS

Illustrative aspects in accordance with the invention will be described in detail with reference to the following figures wherein.

DETAILED DESCRIPTION

An image recording apparatus according to illustrative aspects of the invention will be described while referring to FIGS. 2 through 14.

In the following description, the expressions "front", "rear", "upper", "lower", "right", and "left" are used to define the various parts when the image recording apparatus is disposed in an orientation in which it is intended to be used.

Figure 1A:
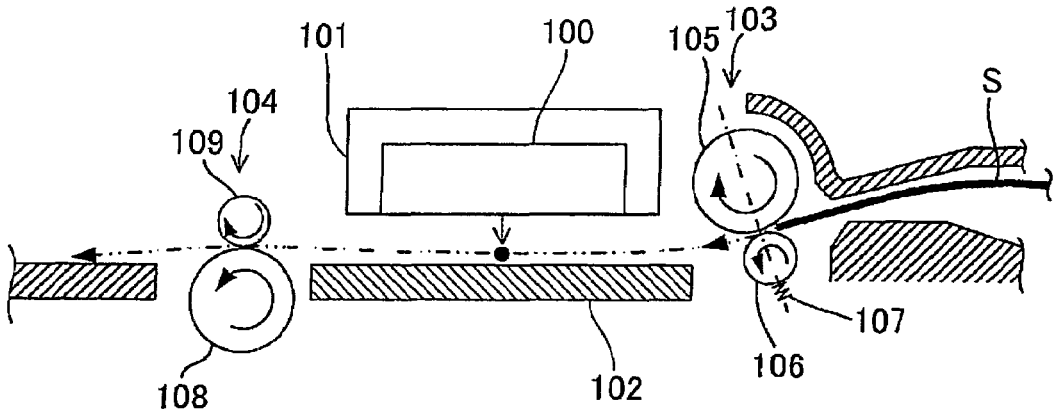
FIGS. 1A through 1C are explanatory diagrams illustrating an example of an image recording apparatus.
Figure 1B:
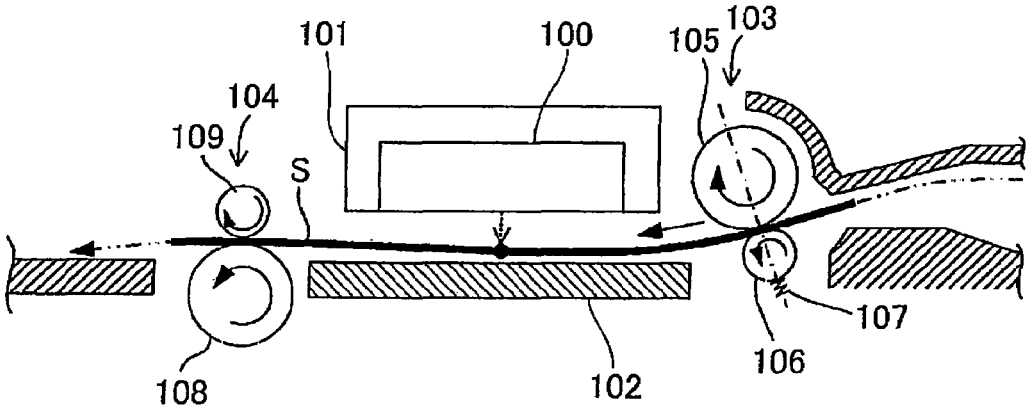
Figure 1C:
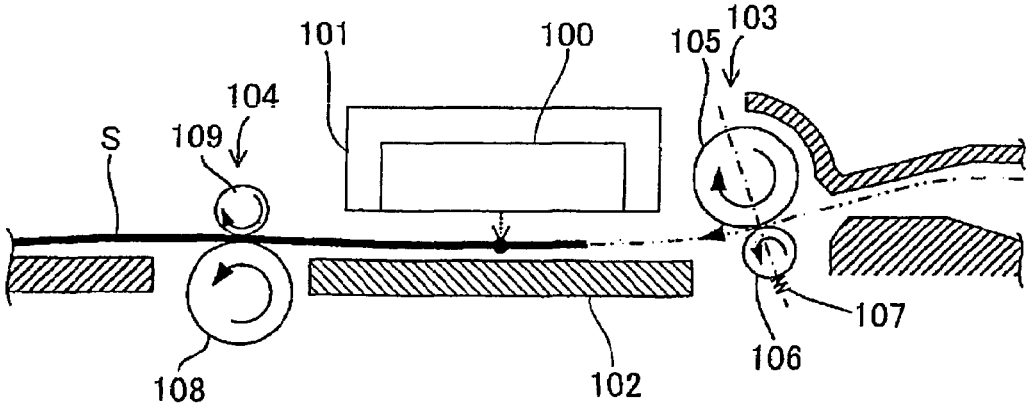
Figure 2:
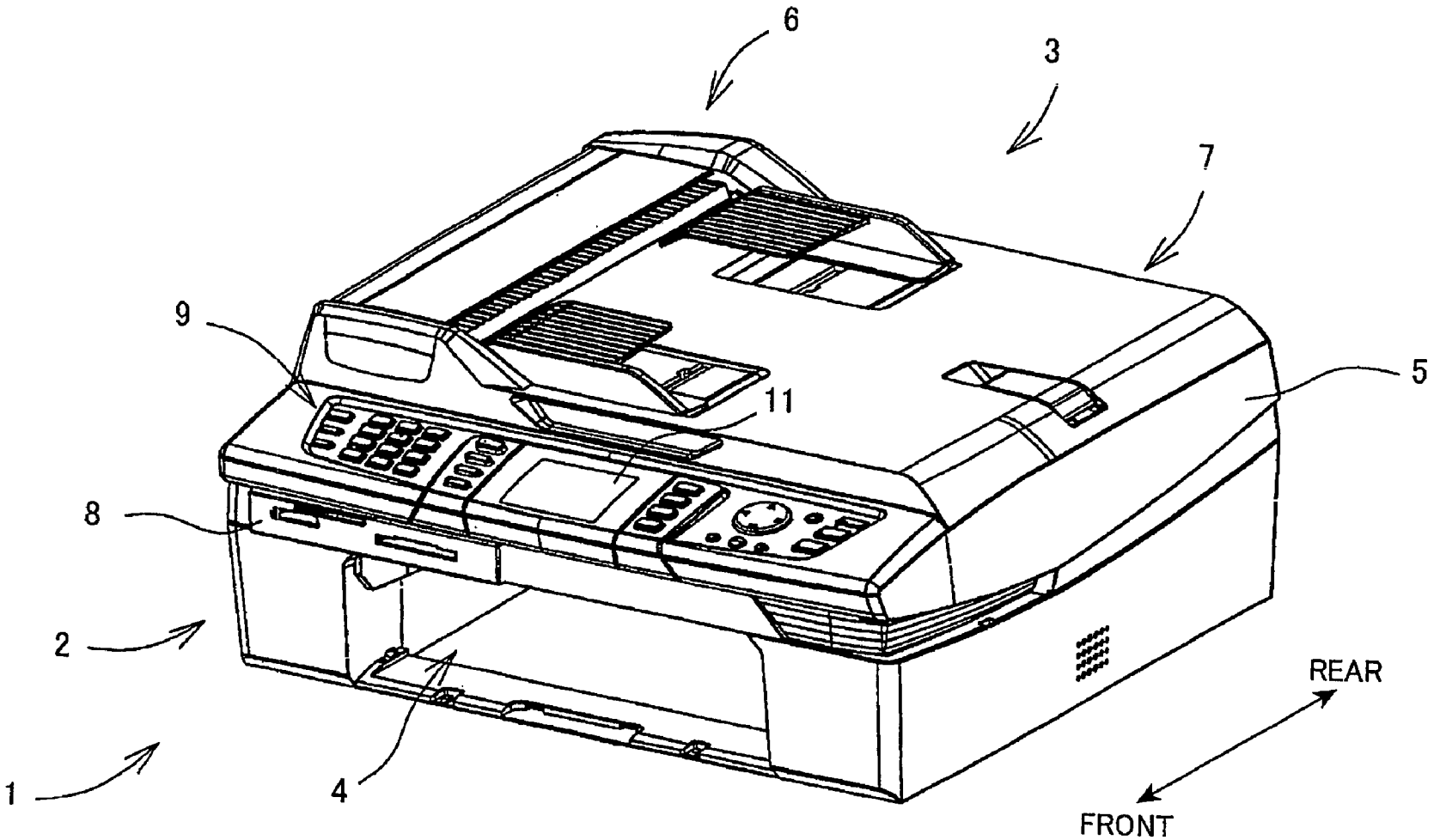
FIG. 2 is a perspective view showing the outer appearance of a multifunction device according to illustrative aspects of the invention.

FIG. 2 is a perspective view showing the outer appearance of a multifunction device 1, serving as the image recording apparatus according to the illustrative aspects. As shown in FIG. 2, the multifunction device 1 is integrally configured of a printing unit 2 disposed in the bottom of the multifunction device 1, a scanning unit 3 disposed in the top of the multifunction device 1, an original cover 7 provided on top of the scanning unit 3, a control panel 9 disposed on the front side and top surface of the multifunction device 1, and a slot section 8 disposed on the front surface of the multifunction device 1. The multifunction device 1 has a printer function, scanner function, copier function, facsimile function, and the like. However, the invention can be realized with any arbitrary combination of functions, such as a scanner function and facsimile function. Hence, the invention may be applied to a standalone printer having only a printer function.

The multifunction device 1 is primarily connected to a computer (not shown) and records images and text on recording paper in the printing unit 2 based on print data including image data and text data that is transferred from the computer. Further, by connecting a digital camera or other external device to the multifunction device 1, the multifunction device 1 can record image data outputted from the external device on recording paper. Similarly, by inserting a memory card or other storage medium in the multifunction device 1, the multifunction device 1 can record image data or the like stored in the storage medium onto recording paper. The multifunction device 1 has a single-sided printing function for recording images and text on only one side of the paper based on the print data, and a duplex printing function for recording both sides of the paper. The structure of the multifunction device 1 in the following description is merely one example of an image recording apparatus according to the invention, and it should be apparent that the structure can be appropriately modified within the scope of the invention.

The control panel 9 is provided on the top front surface of the scanning unit 3, which is also the top surface on the front side of the multifunction device 1, for enabling the user to operate the printing unit 2 and scanning unit 3. The control panel 9 is configured of various operating buttons, and a liquid crystal display unit 11. Hence, the user can operate the multifunction device 1 by inputting instructions via the control panel 9. The operating buttons may be configured of a Start button for initiating operations on the printing unit 2 and scanning unit 3; a Stop button for halting operations or canceling settings; a Mode Selection button for selecting the facsimile function, numerical buttons for inputting the number of copies, the scanning resolution of the scanning unit 3, and the like; a Setting button for setting either single-sided printing (one-sided copying) or duplex printing (double-sided copying); and other input keys. A controller operates the multifunction device 1 based on input from the control panel 9. Of course, when the multifunction device 1 is connected to a computer, as described above, the multifunction device 1 may be operated based on commands received from the computer via a printer driver or a scanner driver.

The slot section 8 is provided on the front surface of the multifunction device 1 near the left side thereof. Various small memory cards can be inserted into the slot section 8. The multifunction device 1 reads image data stored on the memory cards inserted into the slot section 8 and displays data related to this image data on the liquid crystal display unit 11, enabling the user to print desired images on recording paper using the scanning unit 3. The user inputs a selection via the control panel 9.

As shown in FIG. 2, the scanning unit 3 includes an original scanning base 5 functioning as a flatbed scanner The original cover 7 is attached to the original scanning base 5 via hinges (not shown) provided on the rear side surface so as to be capable of opening and closing via the hinges. The original scanning base 5 has a structure that is well known in the art, such as a structure having a contact glass disposed on the top surface, and an image-scanning unit disposed below the contact glass and housing a contact image sensor (CIS). The original cover 7 also includes an automatic document feeder (ADF) 6. When functioning as a flatbed scanner, the scanning unit 3 reads images from an original document placed on the contact glass by exposing and scanning the document as the image-scanning unit is moved under the contact glass. When reading an original image using the ADF 6, the original conveyed by the ADF 6 passes over a scanning surface of the contact glass while the image-scanning unit fixed in a position below the scanning surface reads images from the original. It should also be apparent that the invention may be applied to an image-scanning unit configured of an image sensor, such as a charge-coupled device (CCD) or a complementary metal oxide semiconductor (CMOS). Since the structure of the scanning unit 3 in the invention is arbitrary, a detailed description of the image-scanning unit will not be included in the present aspect.

Figure 3:
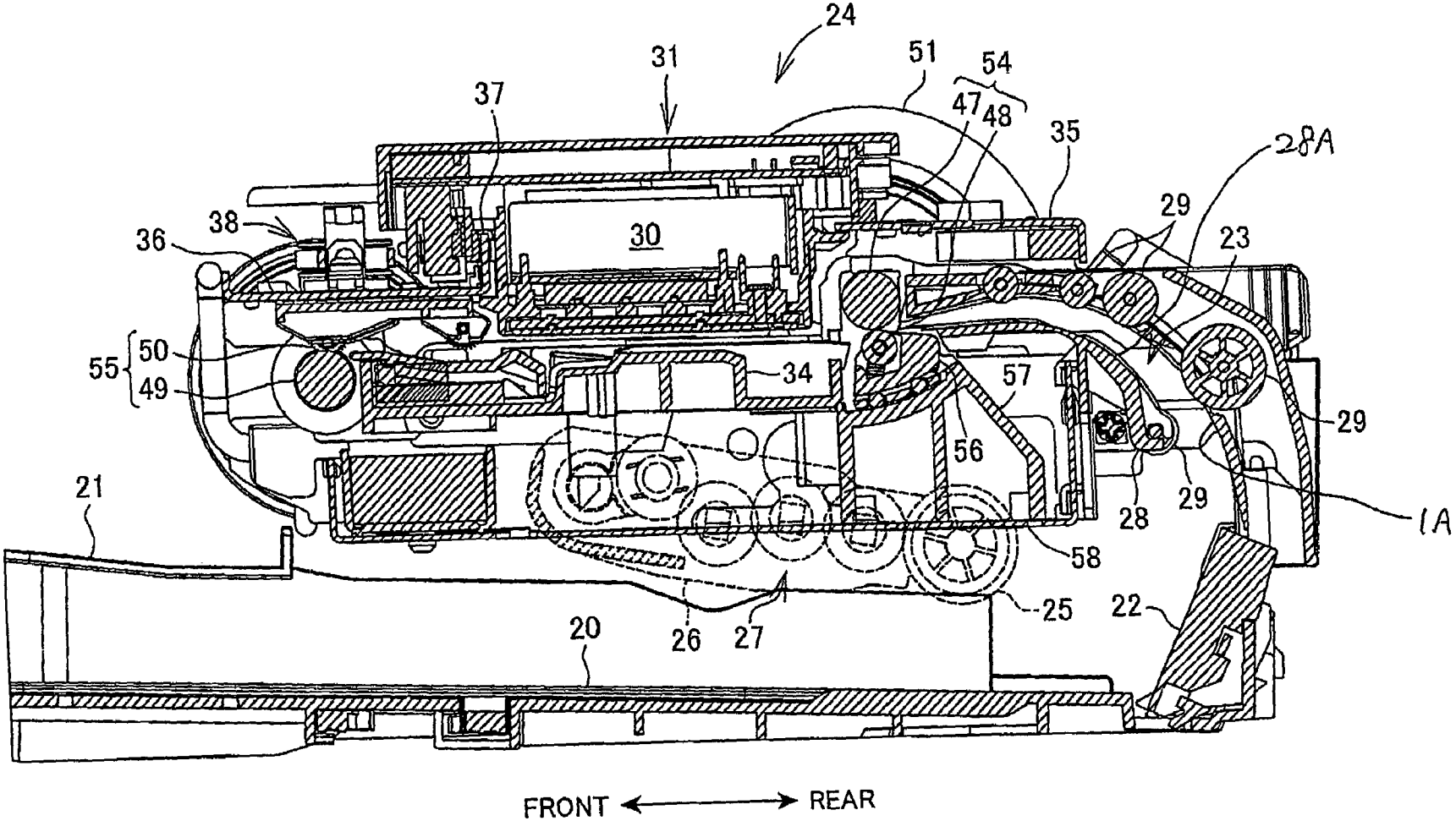
FIG. 3 is a side cross-sectional view of a printing unit provided in the multifunction device of FIG. 2.
Figure 4:
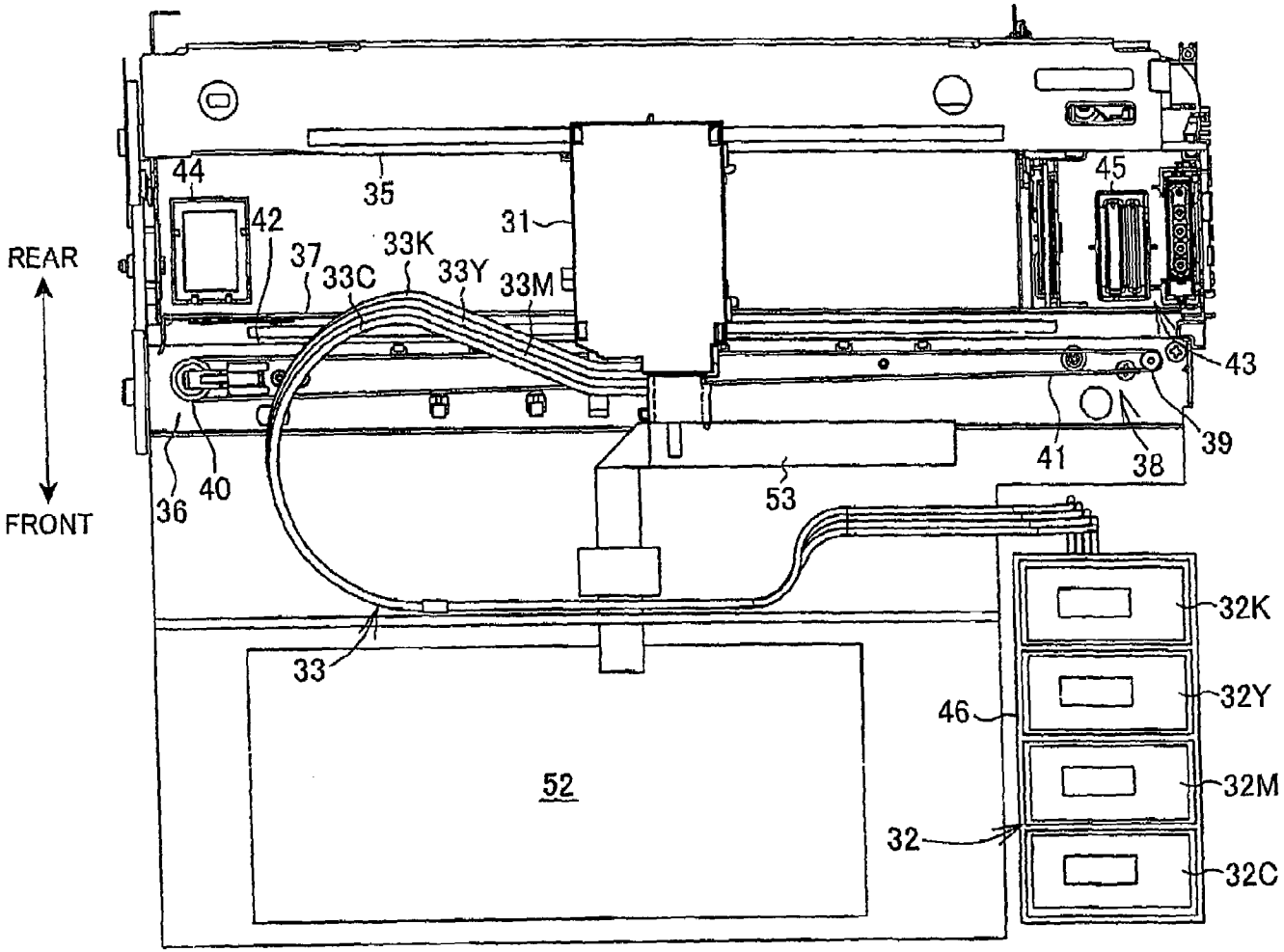
FIG. 4 is a plan view of the printing unit when a scanning unit has been removed.
Figure 5:
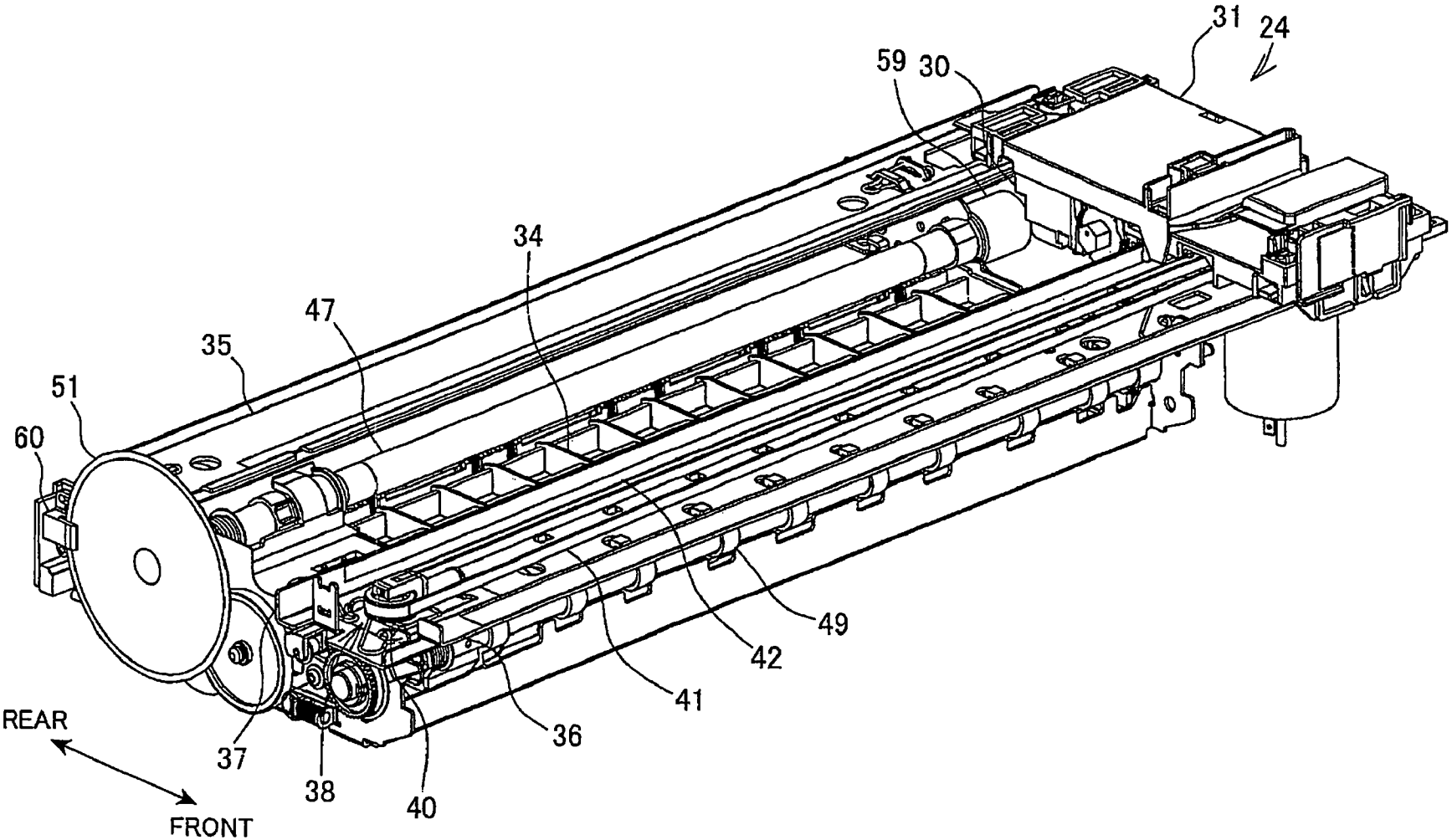
FIG. 5 is a perspective view illustrating the structure around an image recording unit.
Figure 6:
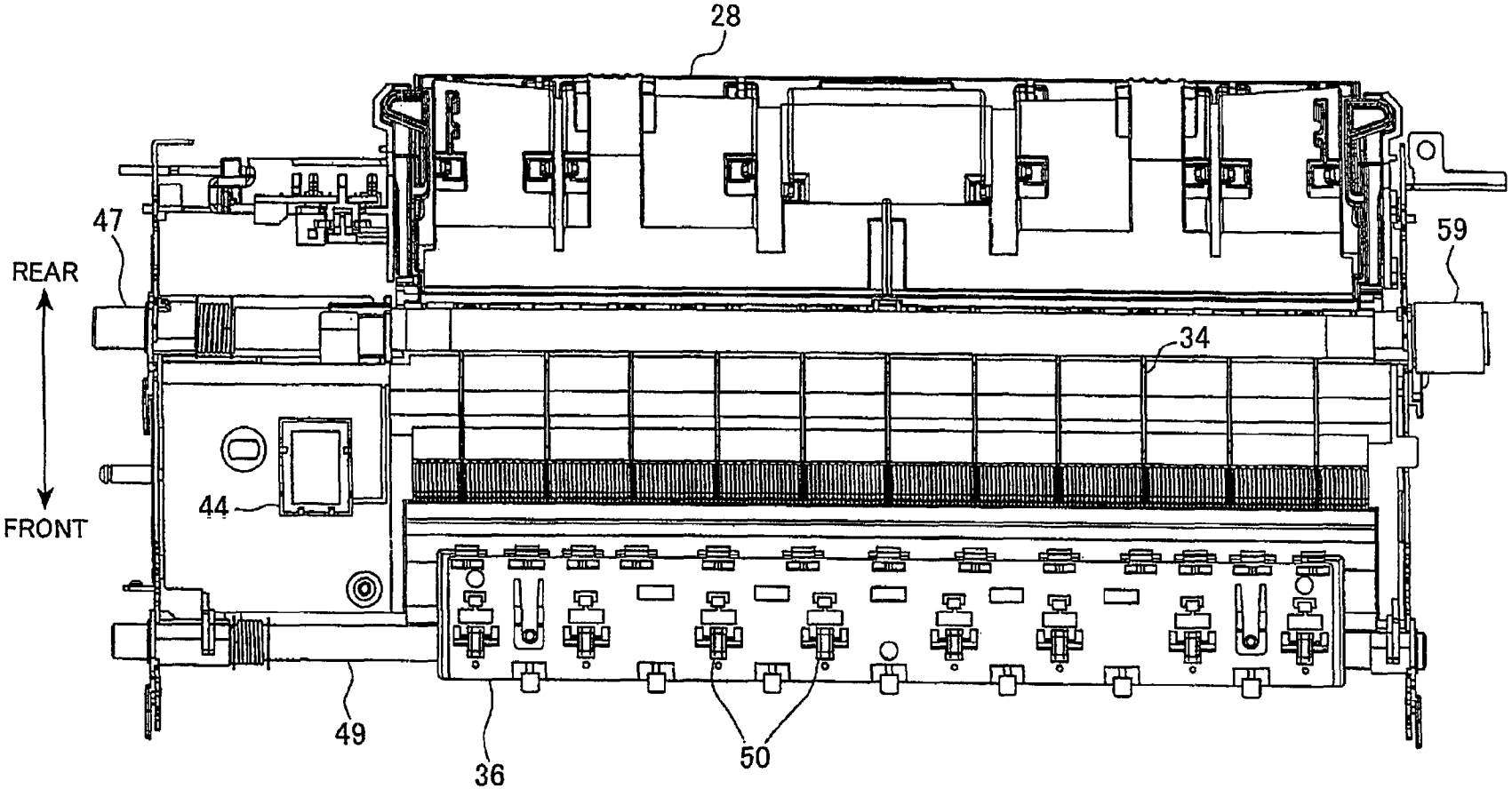
FIG. 6 is a plan view illustrating the structure around the image recording unit.

Next, the structure of the printing unit 2 will be described in detail with reference to FIGS. 2 through 6. FIG. 3 is a side cross-sectional view of the printing unit 2 provided in the multifunction device 1. FIG. 4 is a plan view of the printing unit 2 when the scanning unit 3 has been removed. FIG. 5 is a perspective view illustrating the structure around an image recording unit described later. FIG. 6 is a plan view illustrating the structure around the image recording unit. For convenience, a recording head, belt driving mechanism, guide rail, and purging mechanism described later have been omitted from FIG. 6.

As shown in FIGS. 2 and 3, an opening 4 is formed in the front surface side of the printing unit 2. A paper tray 20 and a discharge tray 21 are mounted in the multifunction device 1 via the opening 4. The paper tray 20 and discharge tray 21 have been omitted from FIG. 2. The paper tray 20 can accommodate a recording paper of a desired size, such as the A4 size or the B5 size. As shown in FIG. 3, the longitudinal direction of paper accommodated in the paper tray 20 extends in the depth direction (the front-to-rear direction) of the multifunction device 1 when the paper tray 20 is mounted in the multifunction device 1. The discharge tray 21 is supported on the paper tray 20 and disposed thereabove. Hence, the paper tray 20 and discharge tray 21 are stacked in two vertical levels when mounted in the multifunction device 1.

A separating sloped surface 22 is provided on the far side (rear side) of the paper tray 20 when the paper tray 20 is mounted in the multifunction device 1. The separating sloped surface 22 functions to separate paper fed from the paper tray 20 and to guide the paper upward.

A conveying path 23 is formed above the separating sloped surface 22. The conveying path 23 extends upward from the top side of the separating sloped surface 22 and curves toward the front surface side of the multifunction device 1. The conveying path 23 extends from the rear side of the multifunction device 1 to the front side, passing through the nip part of a conveying device 54 and below an image recording unit 24 described later and leads to the discharge tray 21. Hence, paper fed from the paper tray 20 is guided to the image recording unit 24 along a U-shaped path from the bottom to the top of the conveying path 23. After the image recording unit 24 records an image on the paper, the paper is discharged onto the discharge tray 21.

A feeding roller 25 is disposed above the paper tray 20. The feeding roller 25 is supported on the rear end of a feed arm 26. The feed arm 26 is capable of moving up and down so that the feeding roller 25 can contact or separate from the paper tray 20. A drive transmission mechanism 27 configured of a plurality of engaged gears transmits a driving force from a motor (not shown) to rotate the feeding roller 25. The feeding roller 25 functions to separate and feed paper stacked on the paper tray 20 to the conveying path 23 one sheet at a time. More specifically, the feeding roller 25 contacts the topmost sheet of recording paper stacked on the paper tray 20 with pressure. By rotating, the feeding roller 25 generates a frictional force between the roller surface of the feeding roller 25 and the recording paper that conveys the topmost sheet of paper to the separating sloped surface 22. The leading edge of the paper fed by the feeding roller 25 contacts the separating sloped surface 22 and is guided upward into the conveying path 23. If a sheet of paper below the topmost sheet is conveyed together with the topmost sheet due to frictional force or static electricity acting between the sheets, the sheet beneath the topmost sheet is halted when contacting the separating sloped surface 22 so that only the topmost sheet is conveyed.

Except for the region occupied by the image recording unit 24 and the like, the conveying path 23 is configured of an outer guide surface and an inner guide surface that confront each other over a predetermined distance. For example, the section of the conveying path 23 formed on the rear side of the multifunction device 1 has an outer guide surface 1A formed integrally with the frame of the multifunction device 1, and an inner guide surface 28A configured of a guide member 28 fixed to the inside of the frame. Conveying rollers 29 are provided at predetermined locations along the conveying path 23 and particularly along the curved region of the conveying path 23. The conveying rollers 29 are disposed so that the surfaces thereof are exposed from the outer guide surface 1A or inner guide surface 28A, and are capable of rotating about axes parallel to the width direction of the conveying path 23. The conveying rollers 29 enable the recording paper to be smoothly conveyed when contacting the guide surfaces 1A and 28A in the curved region of the conveying path 23.

The image recording unit 24 includes a carriage 31 that reciprocates in a main scanning direction (a direction orthogonal to the surface of the drawing in FIG. 3). A recording head 30 is mounted in the carriage 31. Ink in the colors cyan (C), magenta (M), yellow (Y), and black (Bk) is supplied to the recording head 30 from ink tanks 32 via ink tubes 33 (see FIG. 4). The recording head 30 ejects ink of each color as microdroplets through nozzles formed in the bottom surface thereof. The recording head 30 records images on a recording paper conveyed over a platen 34 as the carriage 31 reciprocates in the main scanning direction to scan the recording head 30 over the recording paper.

As shown in FIGS. 4 and 5, a pair of guide rails 35 and 36 is provided on the image recording unit 24 above the conveying path 23. The guide rails 35 and 36 extend in the width direction of the conveying path 23 and are separated from each other in the conveying direction of the recording paper. The carriage 31 is disposed so as to straddle the guide rails 35 and 36 and is capable of sliding over the guide rails 35 and 36 in the width direction of the conveying path 23. The guide rail 35 is disposed on the upstream side in the paper-conveying direction (the rear side) and has a plate shape that is longer in the width direction of the conveying path 23 than the scanning range of the carriage 31. The top surface of the guide rail 35 slidably supports the upstream end of the carriage 31.

The guide rail 36 disposed on the downstream side in the paper-conveying direction (the front side) is plate-shaped and has a length in the width direction of the conveying path 23 that is substantially the same as the guide rail 35. The top surface of the guide rail 36 is bent at substantially a right angle to form an end part 37 angled upward on the upstream side of the guide rail 36 in the paper-conveying direction. An engaging member (not shown) is provided on the carriage 31 for engaging with the end part 37 of the guide rail 36 by gripping both sides of the end part 37. In this way, the carriage 31 is slidably supported on the guide rails 35 and 36 and is capable of reciprocating in the width direction of the conveying path 23 along the end part 37 of the guide rail 36. A pair of rollers or the like may also be used in place of the engaging member for gripping the end part 37. Further, sliding members may also be provided on portions of the surfaces of the guide rails 35 and 36 contacted by the carriage 31 to reduce friction.

A belt-driving mechanism 38 is provided on the top surface of the guide rail 36. The belt-driving mechanism 38 includes a drive pulley 39 and a follow pulley 40 disposed near both widthwise ends of the conveying path 23, and an endless timing belt 41 disposed around the drive pulley 39 and follow pulley 40. The timing belt 41 has teeth formed on the inner side surface thereof. A motor (not shown) is coupled to the shaft of the drive pulley 39 for inputting a driving force into the shaft of the drive pulley 39. When the drive pulley 39 rotates, the timing belt 41 moves in a circuitous motion. The timing belt 41 may also be configured of a belt having ends, both of which ends are fixed to the carriage 31.

The carriage 31 is fixed to the timing belt 41. By moving the timing belt 41 circuitously, the carriage 31 reciprocates over the guide rails 35 and 36 in a position based on the end part 37. Since the recording head 30 is mounted in the carriage 31, the recording head 30 also reciprocates together with the carriage 31 along the width direction of the conveying path 23, which is the main scanning direction. An encoder strip 42 of a linear encoder is provided on the guide rail 36 along the end part 37. The linear encoder detects the encoder strip 42 with a photointerrupter, and a controller (not shown) controls the reciprocating motion of the carriage 31 based on detection signals from the linear encoder.

Figure 7:
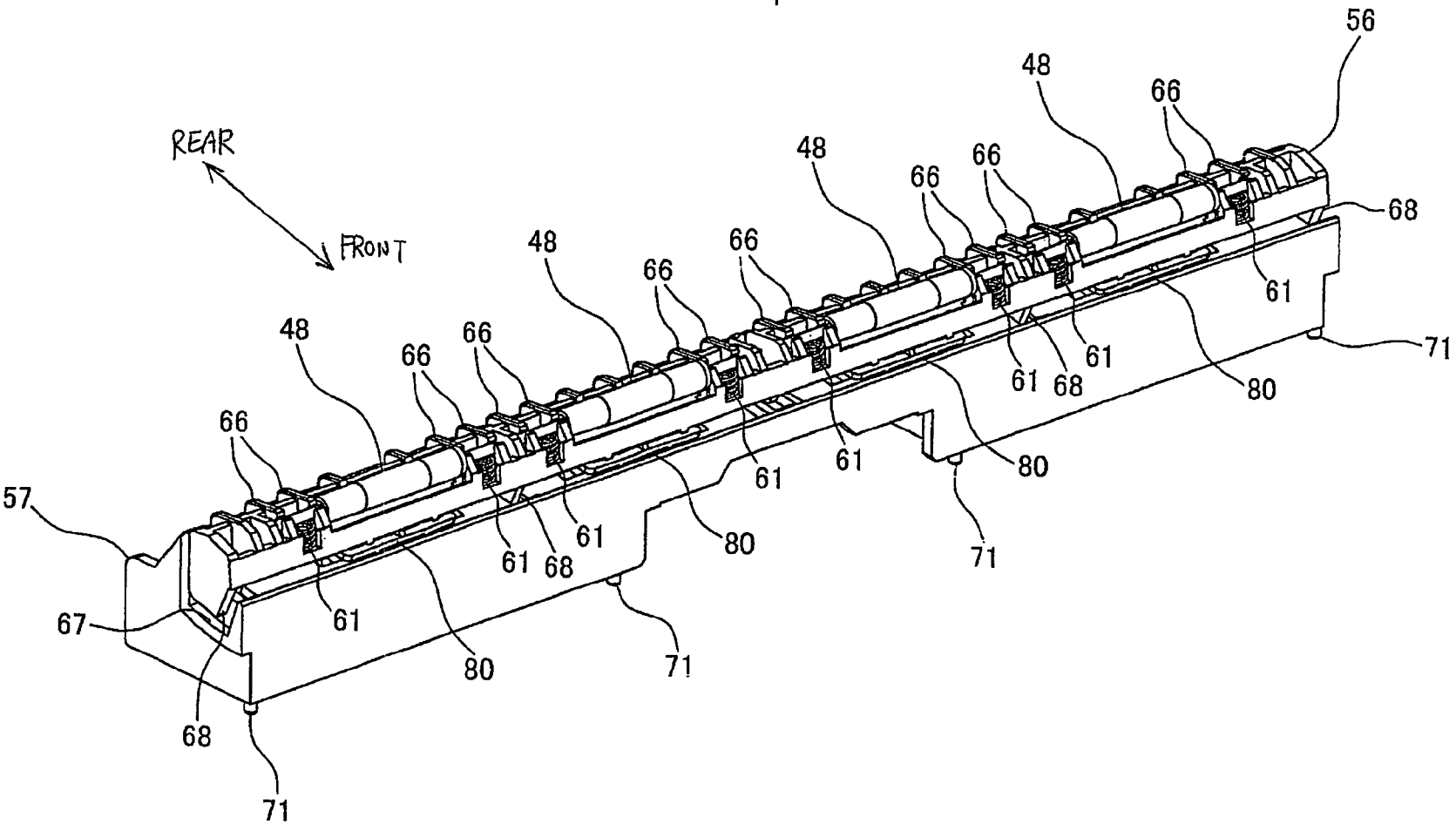
FIG. 7 is a perspective view showing a pinch roller holder supported on a holder support member.

As shown in FIGS. 3, 5, and 7, the platen 34 is disposed on the bottom of the conveying path 23 in confrontation with the recording head 30. The platen 34 extends over the center region within the reciprocating range of the carriage 31 through which the recording paper passes. The width of the platen 34 is sufficiently larger than the maximum width of recording paper that can be conveyed in the multifunction device 1 so that both edges of the paper pass over the platen 34.

As shown in FIG. 4, a purging mechanism 43 and a waste ink tray 44 are disposed outside the image recording range of the recording head 30 and, more specifically, in regions on both sides of the platen 34 through which the recording paper does not pass. The purging mechanism 43 functions to draw out air bubbles and foreign matter along with ink from nozzles and the like formed in the recording head 30. The purging mechanism 43 includes a cap 45 for covering the nozzle surface of the recording head 30. A pump mechanism is connected to the cap 45. A moving mechanism is also provided for moving the cap 45 to contact or separate from the nozzle surface of the recording head 30. When an operation is performed to remove air bubbles and the like from the recording head 30, the carriage 31 is moved so that the recording head 30 is positioned above the cap 45. Subsequently, the moving mechanism moves the cap 45 upward to form a hermetic seal over the nozzles formed in the bottom surface of the recording head 30. The pump mechanism coupled to the cap 45 then draws out ink from the nozzles.

The waste ink tray 44 is disposed on the opposite side from the purging mechanism 43 in the width direction in a position outside the image-forming range of the carriage 31. The waste ink tray 44 receives ink that has been flushed out of the recording head 30 (this operation is called "flushing"). The purging mechanism 43 and waste ink tray 44 constitute a maintenance unit that can perform such maintenance as removing air bubbles and mixed ink of different colors from the recording head 30.

As shown in FIG. 4, the ink tanks 32 are accommodated in an ink tank accommodating section 46 disposed in the front right side of the printing unit 2. The ink tanks 32 are provided separately from the carriage 31 and recording head 30 in the printing unit 2. The ink tanks 32 include four ink tanks 32C, 32M, 32Y, and 32K accommodating ink of the respective colors cyan (C), magenta (M), yellow (Y), and black (Bk). The ink tanks 32 supply ink to the carriage 31 via the ink tubes 33.

Ink from the ink tanks 32C, 32M, 32Y, and 32K accommodated in the ink tank accommodating section 46 is supplied through the ink tubes 33, which are provided independently for each color. The ink tubes 33 are tubes formed of synthetic resin and are flexible so as to be able to bend when the carriage 31 moves in a scanning motion. Openings formed at one end of the ink tubes 33 are connected to respective joints provided at ink tank accommodating positions in the ink tank accommodating section 46. The ink tube 33C corresponds to the ink tank 32C and supplies cyan ink therefrom. Similarly, the ink tubes 33M, 33Y, and 33K correspond to the ink tanks 32M, 32Y, and 32K and supply the corresponding ink colors magenta, yellow, and black therefrom.

From the ink tank accommodating section 46, the ink tubes 33 are led along the width direction of the multifunction device 1 to a position near the center thereof, at which position the ink tubes 33 are fixed to an appropriate member on the device frame or the like. The section of the ink tubes 33 from the fixed part to the carriage 31 is a U-shaped curved portion that is not fixed to the device frame or the like and that changes in shape as the carriage 31 reciprocates. Hence, as the carriage 31 moves toward one end (the left side in FIG. 4) in the reciprocating direction, the ink tubes 33 move in the same direction as the carriage 31 while flexing so that a curved radius of the U-shaped curved portion grows smaller. When the carriage 31 moves to the other end (the right side in FIG. 4) in the reciprocating direction, the ink tubes 33 move in the same direction while flexing so that the curved radius of the U-shaped curved portion grows larger.

As shown in FIGS. 3, 5, and 7, a pair of conveying rollers 54 having a drive roller 47 and a pinch roller 48 disposed below the drive roller 47 is provided on the upstream side of the image recording unit 24. The drive roller 47 and pinch roller 48 pinch a recording paper conveyed along the conveying path 23 and convey the recording paper over the platen 34. The pinch roller 48 is rotatably supported on a pinch roller holder 56 so as to press against the drive roller 47 with a predetermined urging force. The pinch roller holder 56 is supported by a holder support member 57 integrally provided on the internal frame 58 constituting part of the casing in the multifunction device 1 so as to be capable of rolling in the conveying direction of the paper. With this construction, the pinch roller holder 56 rolls to a conveying position on the downstream side, shown in FIG. 14, when the conveying rollers 54 are conveying the recording paper and roll to a retracted position on the upstream side, shown in FIG. 13, when the trailing edge of the recording paper leaves the conveying rollers 54. A detailed description of the structures of the holder support member 57 and pinch roller holder 56 and the supporting structure for supporting the pinch roller holder 56 on the holder support member 57 is given below.

A pair of discharge rollers 55 is provided on the downstream side of the image recording unit 24 and includes a drive roller 49, and spur rollers 50 disposed above the drive roller 49. The drive roller 49 and spur rollers 50 grip and convey the recording paper after an image has been recorded thereon. The surfaces of the spur rollers 50 are formed irregularly in a spur-like configuration so as not to degrade the image recorded on the paper.

As shown in FIGS. 5 and 6, a motor 59 is coupled to one axial end of the drive roller 47. A driving force transmitted from the motor 59 drives the drive rollers 47 and 49 to rotate intermittently at predetermined linefeed widths. The drive roller 47 and drive roller 49 rotate in synchronization. As shown in FIG. 5, a rotary encoder includes an encoder disc 51 provided on the drive roller 47, and a photointerupter 60 for detecting the encoder disc 51. The rotations of the drive rollers 47 and 49 are detected based on detection signals from the rotary encoder.

Hence, paper interposed between the drive roller 47 and pinch roller 48 is conveyed intermittently over the platen 34 at predetermined linefeed widths. The recording head 30 scans the paper after each linefeed to record an image beginning from the leading edge side of the paper. After an image has been recorded on the paper, the leading edge side becomes interposed between the drive roller 49 and spur rollers 50. At this time, the paper is conveyed intermittently at the predetermined linefeed widths, while the leading edge side of the paper is interposed between the drive roller 49 and spur rollers 50, and the trailing edge side is interposed between the drive roller 47 and pinch roller 48, during which time the recording head 30 continues recording an image on the paper. After the paper is conveyed farther, the trailing edge of the paper passes through and separates from the drive roller 47 and pinch roller 48. Hence, the paper is conveyed intermittently at the predetermined linefeed widths while interposed only between the drive roller 49 and spur rollers 50 as the recording head 30 continues to record an image after each linefeed. When the trailing edge of the recording paper comes out of the drive roller 47 and pinch roller 48, the pinch roller holder 56 simultaneously rolls to the retracted position downstream, shown in FIG. 13. After the recording head 30 has completed recording an image in the predetermined region of the paper, the drive roller 49 is driven to rotate continuously so that the paper interposed between the drive roller 49 and spur rollers 50 is discharged onto the discharge tray 21.

As shown in FIG. 4, the control circuit board 52 is disposed on the front surface side of the multifunction device 1. Recording signals are transmitted from the control circuit board 52 to the recording head 30 via a flat cable 53. The flat cable 53 is an insulated ribbon cable configured of conductors for transmitting electric signals coated in a synthetic resin film, such as a polyester film The flat cable 53 electrically connects the control circuit board 52 to a control circuit board (not shown) in the recording head 30. The flat cable 53 extends in the reciprocating direction from the carriage 31 and is folded back to form substantially a U-shaped portion. The U-shaped portion is not fixed to any other member and changes in shape as the carriage 31 reciprocates.

Figure 8:
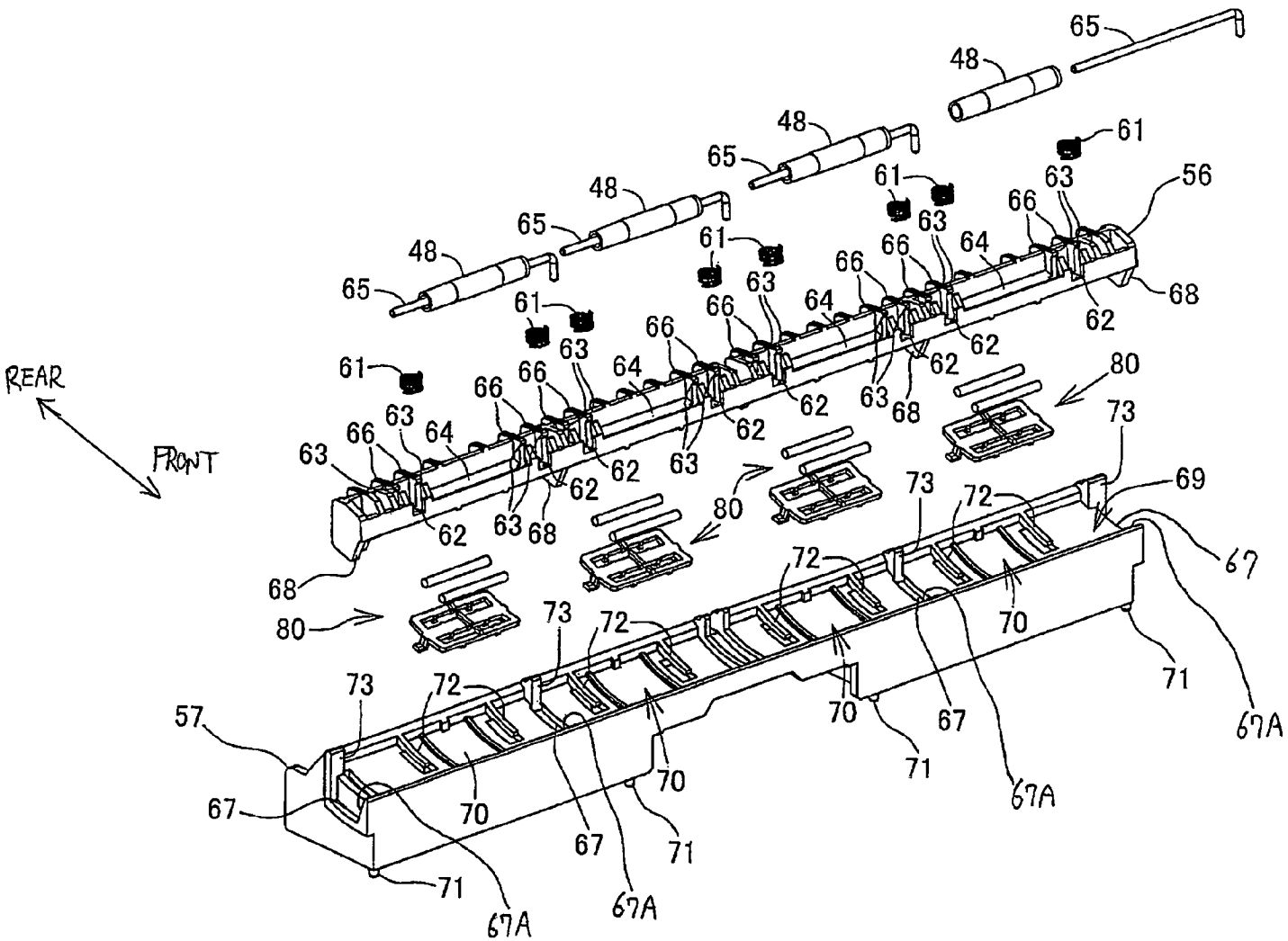
FIG. 8 is an exploded view of the holder support member and pinch roller holder.
Figure 9:
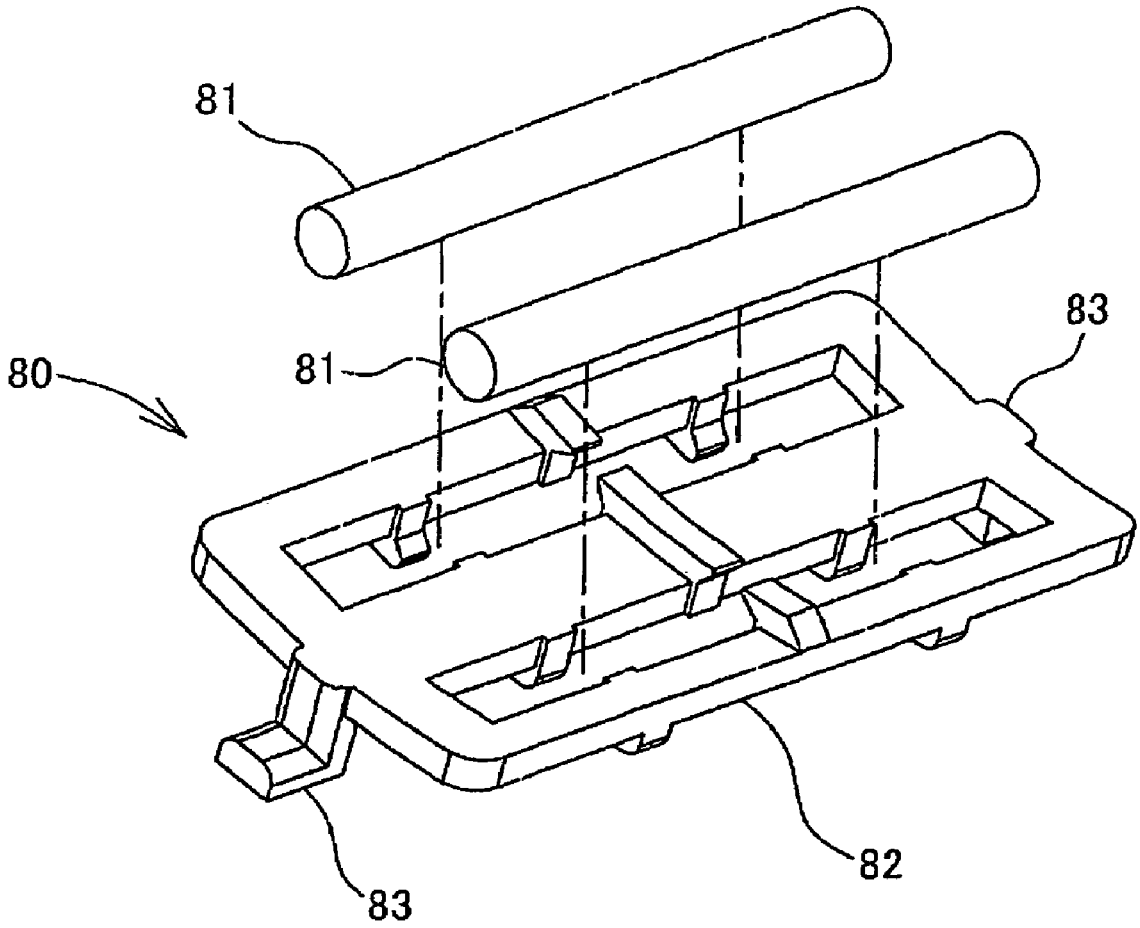
FIG. 9 is a perspective view showing the structure of a roller bearing.
Figure 10:
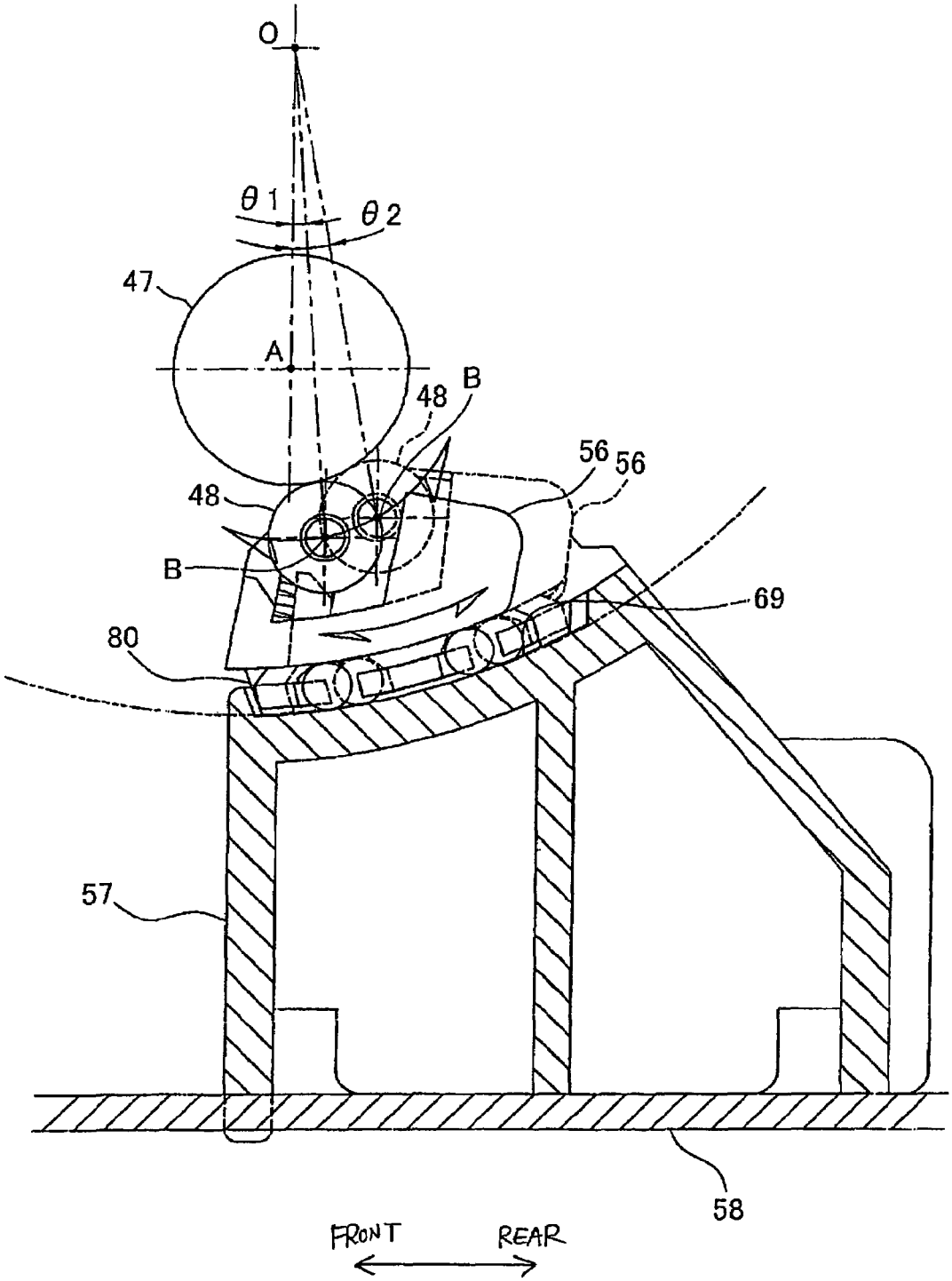
FIG. 10 is an enlarged view illustrating the moving range of the pinch roller holder.

Next, the structures of the holder support member 57 and pinch roller holder 56 and the support structure for the pinch roller holder 56 will be described in detail with reference to FIGS. 7 through 10. FIG. 7 is a perspective view showing the pinch roller holder 56 supported on the holder support member 57. FIG. 8 is an exploded view of the holder support member 57 and pinch roller holder 56. FIG. 9 is a perspective view showing the structure of the roller bearing 80. FIG. 10 is an enlarged view illustrating the moving range of the pinch roller holder 56.

As shown in FIGS. 7 and 8, the pinch roller holder 56 has an elongated shape and is oriented so that the longitudinal direction matches the width direction of the recording paper. Four roller-accommodating compartments 64, and eight spring-accommodating compartments 62 are provided on the top surface of the pinch roller holder 56 confronting the drive roller 47. The roller-accommodating compartments 64 are formed at predetermined intervals along the longitudinal direction of the pinch roller holder 56. The spring-accommodating compartments 62 are formed adjacent to and on both ends of the roller-accommodating compartments 64. The pinch rollers 48 are accommodated in the roller-accommodating compartments 64 and have rotational shafts 65 aligned with the longitudinal direction of the pinch roller holder 56. The springs 61 are accommodated in the spring-accommodating compartments 62 in a compressed state. This structure is one example, but it should be apparent that the number of pinch rollers 48 and springs 61 and the accommodating method may be modified as appropriate.

The spring-accommodating compartments 62 are defined by partitioning plates 66 erected on both longitudinal sides of the spring-accommodating compartments 62. A bearing 63 is formed in each partitioning plate 66 for supporting the rotational shaft 65 of the respective pinch roller 48. The bearings 63 are formed as long vertical grooves in the partitioning plates 66. The upper ends of the bearings 63 are formed slightly smaller than the diameter of the rotational shafts 65. When the rotational shafts 65 are pressed into the bearings 63, the upper ends of the grooves elastically expand so that the bearings 63 can receive the rotational shafts 65. The upper ends of the grooves return to their original shape after the rotational shafts 65 are completely inserted, preventing the rotational shafts 65 from easily coming out of the bearings 63. With this construction, the bearings 63 support the rotational shafts 65 so that the rotational shafts 65 can move vertically.

By housing the springs 61 in the spring-accommodating compartments 62 and inserting the rotational shafts 65 of the pinch rollers 48 into the bearings 63, the springs 61 are mounted in the spring-accommodating compartments 62 in a compressed state. The elastic force of the compressed springs 61 urges the pinch rollers 48 upward. In other words, an urging force toward the drive roller 47 is applied to the pinch rollers 48. Hence, the pinch rollers 48 are urged by the springs 61 and rotatably supported by the bearings 63. Accordingly, when a thick sheet of recording paper is conveyed through the multifunction device 1, the paper pushes the pinch rollers 48 downward against the urging force of the springs 61 by a distance corresponding to the paper thickness.

Four protruding pieces 68 are formed on the bottom surface of the pinch roller holder 56. The protruding pieces 68 are designed to engage with four engaging grooves 67 (see FIG. 8) formed in the holder support member 57. The protruding pieces 68 are plate-shaped members protruding downward from the bottom surface of the pinch roller holder 56 and extend along the short dimension of the pinch roller holder 56. By inserting the protruding pieces 68 into the engaging grooves 67, the protruding pieces 68 fit into the engaging grooves 67 with a predetermined amount of play. With this construction, the pinch roller holder 56 is supported on the holder support member 57 so as to be capable of moving in the short dimension of the holder support member 57, that is, in the conveying direction of the recording paper, while the amount of movement is restricted to a predetermined range.

The holder support member 57 is formed in an elongated shape similar to the pinch roller holder 56 and is disposed on the internal frame 58 so that the longitudinal dimension of the holder support member 57 matches the width dimension of the recording paper. More specifically, as shown in FIG. 3, the holder support member 57 is positioned on the internal frame 58 by fitting protrusions 71 formed on the bottom surface of the holder support member 57 into holes (not shown) formed in the internal frame 58. As shown in FIG. 10, a curved surface 69 (supporting surface) is formed on the top surface of the holder support member 57. The top surface 69 supports the bottom surface (support part) of the pinch roller holder 56 via roller bearings 80 interposed therebetween.

As shown in FIG. 10, the top surface 69 of the holder support member 57 slopes downward from the upstream side to the downstream side in the conveying direction. The top surface 69 has an arc shape that substantially conforms to the outer periphery of a cylindrical path about the center of revolution O, where the center of revolution O is parallel to a rotational center A of the drive roller 47 and exists in a vertical plane passing through the rotational center A. Hence, the pinch roller holder 56 moves along a path about the center of revolution O by rolling over the top surface 69. Since the springs 61 urge the pinch rollers 48 at this time, the pinch rollers 48 move over the peripheral surface of the drive roller 47 while constantly pressing against the drive roller 47. The center of revolution O should be positioned so that the distance between the center of revolution O and the top surface 69 of the holder support member 57 is greater than the distance between the rotational center B of the pinch rollers 48 and the top surface 69.

As shown in FIGS. 8 and 9, the roller bearing 80 is configured of two rollers 81 juxtaposed in parallel along the short dimension of the holder support member 57, and a roller support member 82 for rotatably supporting the two rollers 81 together. The roller support member 82 is mounted on the top surface 69 of the holder support member 57 with the rollers 81 supported therein. Specifically, engaging pawls 83 having a substantially L-shaped cross section are formed one on each longitudinal end of the roller support member 82. The roller bearing 80 is mounted by engaging the engaging pawls 83 in engagement parts 72 formed in the top surface 69. As shown in the drawings, four of the roller bearings 80 are mounted at predetermined intervals along the longitudinal direction of the holder support member 57. By interposing roller bearings 80 having this structure between the pinch roller holder 56 and the top surface 69 of the holder support member 57, the pinch roller holder 56 is rollingly supported on the top surface 69. However, while the illustrative aspects give one example of using the roller bearings 80 as a support structure for rollingly supporting the pinch roller holder 56, it is possible to employ another structure that integrally provides freely rotatably rotary members on the top surface 69 of the holder support member 57 or the bottom surface of the pinch roller holder 56. For example, it is conceivable to incorporate roller bearings or ball bearings well known in the art in the top surface 69 or the bottom surface of the pinch roller holder 56.

Four of the engaging grooves 67 are formed in the top surface 69 of the holder support member 57 for engaging with the protruding pieces 68 described above. The engaging grooves 67 are formed sufficiently longer in the short dimension of the pinch roller holder 56 than the length of the protruding pieces 68 in the same direction. Ribs 73 extending upward from the top surface 69 of the holder support member 57 are formed on the rear ends of the engaging grooves 67, continuing upward from the inner wall and rear side of the engaging grooves 67. The ribs 73 function to restrict rearward movement of the pinch roller holder 56. When the pinch roller holder 56 is supported on the holder support member 57 so as to be capable of moving in the short dimension of the holder support member 57 while the protruding pieces 68 are engaged with the engaging grooves 67, forward movement of the pinch roller holder 56 is restricted when the front ends of the protruding pieces 68 contact inner walls 67A on the front sides of the engaging grooves 67, and rearward movement of the pinch roller holder 56 is restricted by the rear ends of the protruding pieces 68 contacting the ribs 73. In the illustrative aspects, the movable range of the pinch roller holder 56 in the short dimension of the holder support member 57 is restricted between a conveying position and a retracted position. As shown in FIG. 10, the conveying position is the position of the pinch roller holder 56 when a line connecting the center of revolution O and the rotational center B of the pinch roller 48 on the rear side of the drive roller 47 forms an angle $\theta 1$ with a vertical plane passing through the center of revolution O, and the retracted position is the position of the pinch roller holder 56 when a line connecting the center of revolution O and the rotational center B of the pinch roller 48 forms an angle $\theta 2$ ($>\theta 1$) with the same vertical plane. With this configuration of the pinch roller holder 56 and holder support member 57, the pinch roller holder 56 moves to the conveying position when the conveying rollers 54 are pinching and conveying a recording paper, and moves to the retracted position when the trailing edge of the recording paper comes out of the conveying rollers 54. Next, the rolling principle of the pinch roller holder 56 will be described with reference to FIGS. 11 and 12.

Figure 11:
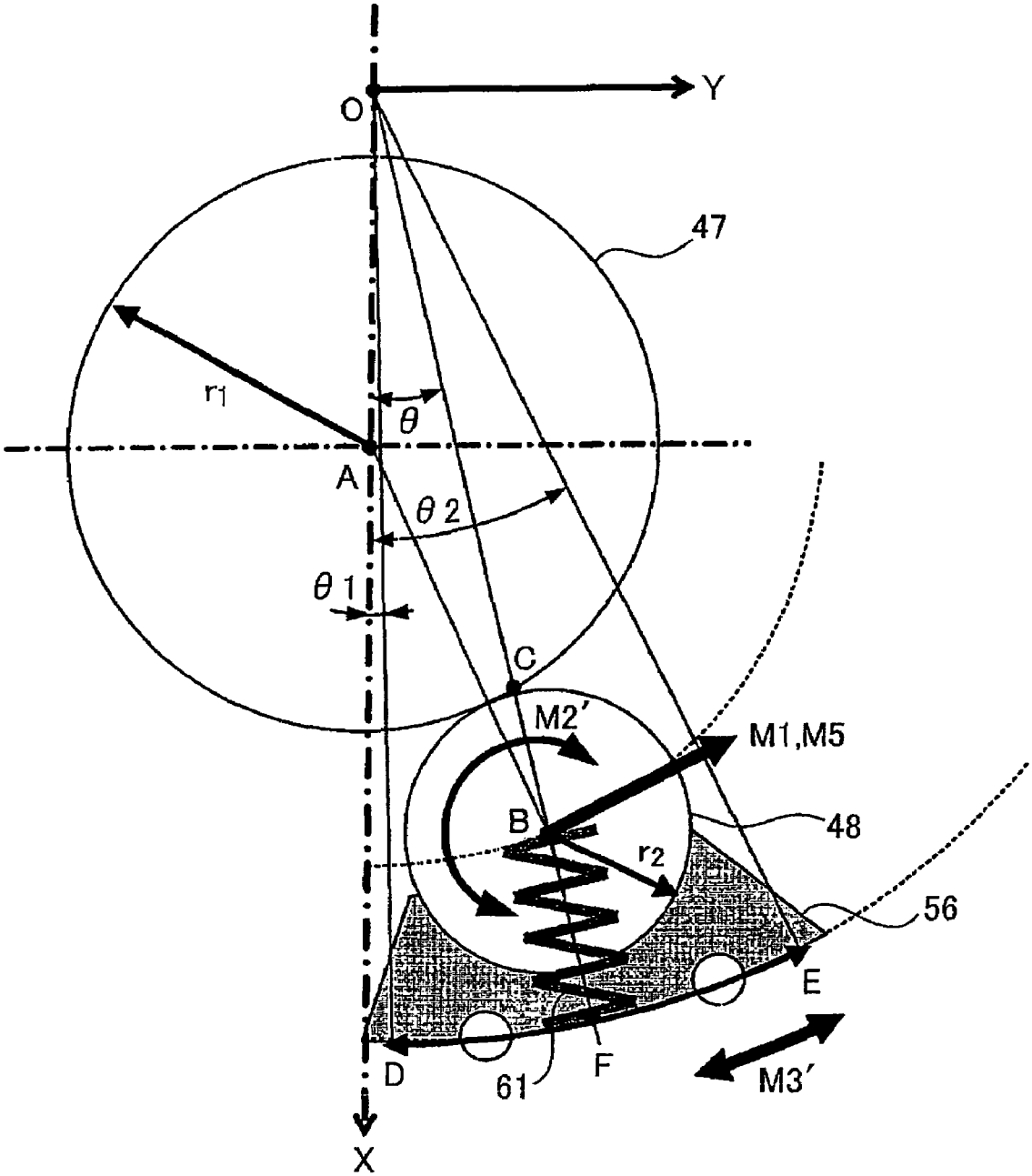
FIG. 11 is an explanatory diagram illustrating a cross section of a drive roller and pinch roller in an XY coordinate system having a center of revolution O as the point of origin.
Figure 12:
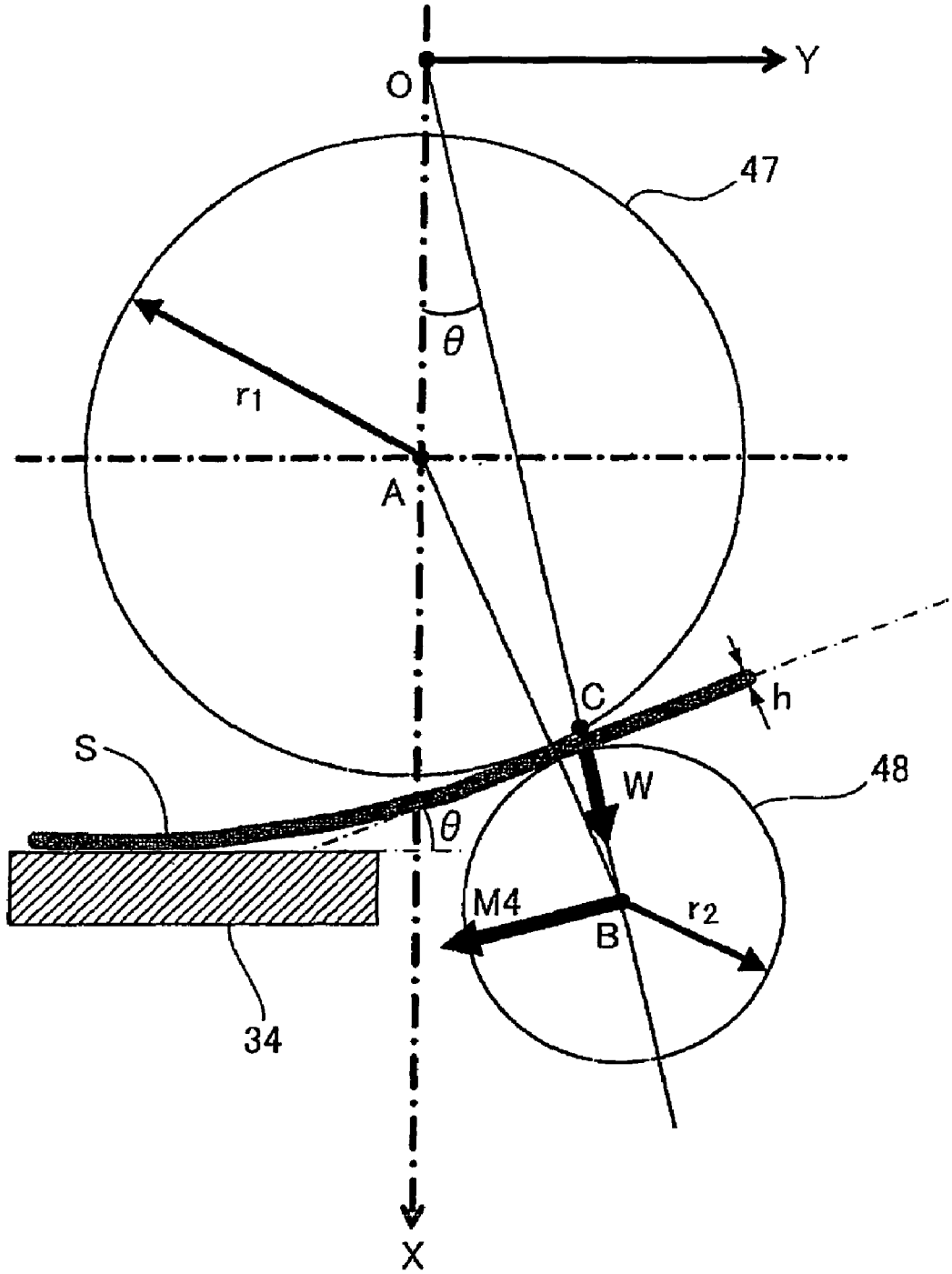
FIG. 12 is an explanatory diagram showing the state of the recording paper interposed in the structure of FIG. 11.
Figure 13:
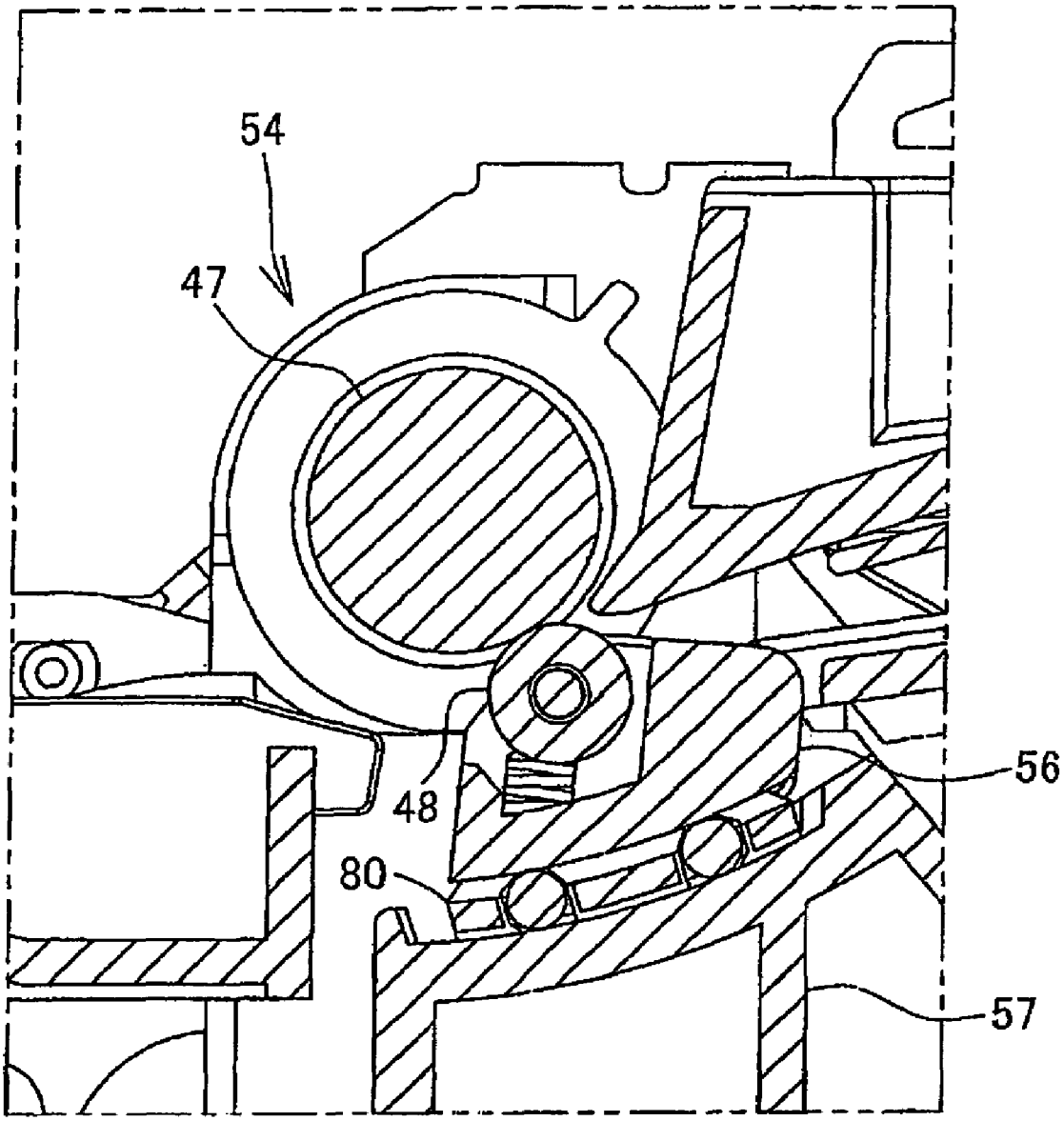
FIG. 13 is a partial cross-sectional view showing the state of the pinch roller holder in a retracted position.
Figure 14:
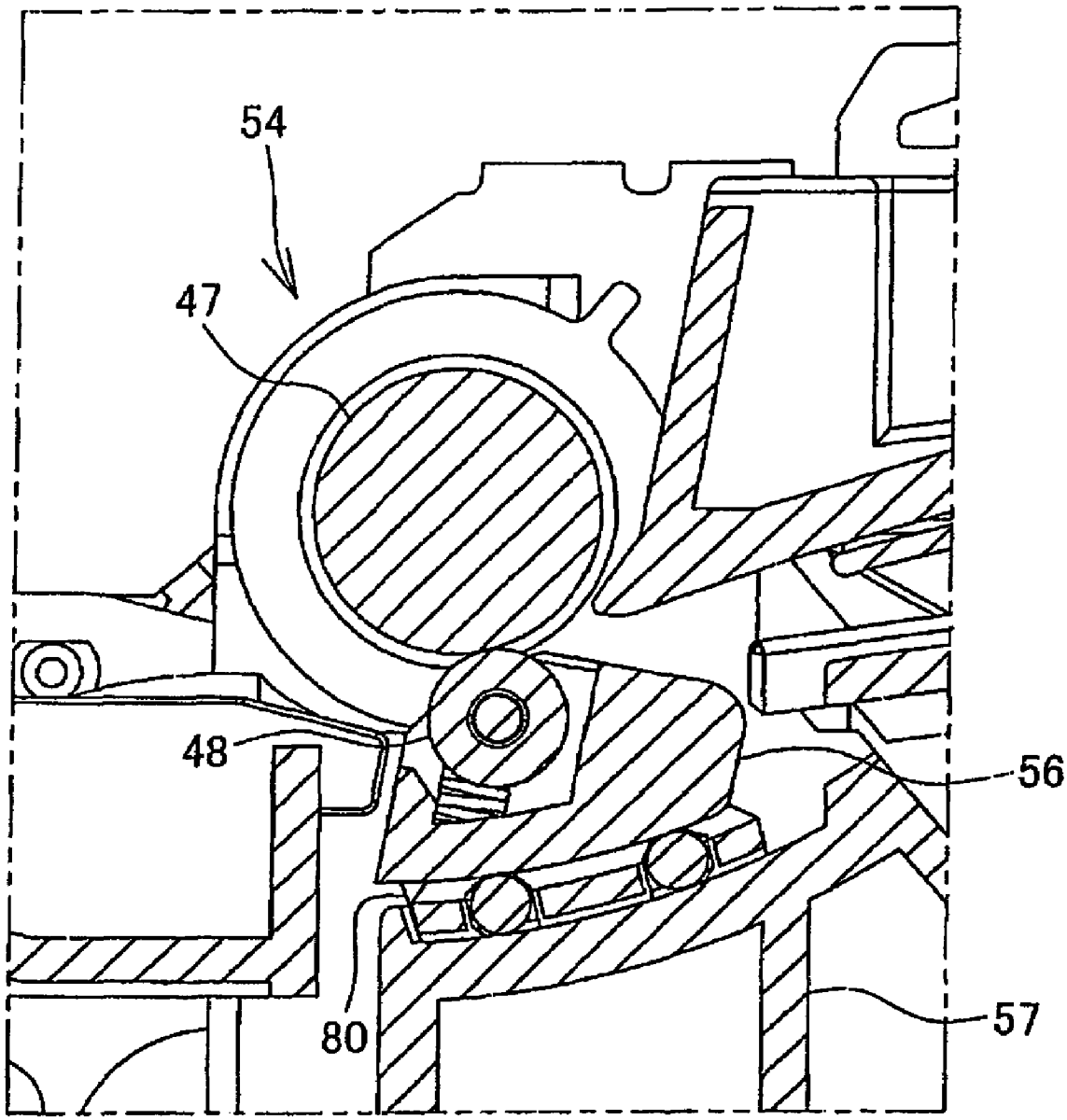
FIG. 14 is a partial cross-sectional view showing the state of the pinch roller holder in a conveying position.

FIG. 11 is an explanatory diagram illustrating a cross section of the drive roller 47 and pinch roller 48 in an XY coordinate system having the center of revolution O as the point of origin. FIG. 12 is an explanatory diagram showing the state of the recording paper interposed in the structure of FIG. 11. In these drawings, the drive roller 47 has a rotational center A and a radius r1, and the pinch roller 48 has a rotational center B and a radius r2. The rotational center A is positioned on the X-axis, with the point of origin O at a position separated a distance greater than the radius r1 of the drive roller 47 in the -X direction from the rotational center A. The point of origin O conforms to the center of a cylindrical path including the top surface 69, that is, the center of revolution O. The pinch roller holder 56 can rollingly move about the point of origin O between a position D rotated the angle $\theta 1$ from the X-axis in the counterclockwise direction, and a position E rotated an angle $\theta 2$ ($>\theta 1$) from the X-axis in the same direction. Here, the position D corresponds to the conveying position, while the position E corresponds to the retracted position. In other words, an imaginary plane (a plane including the X-axis and perpendicular to the surface of FIG. 11) including the rotational axis A of the drive roller 47 and the center of revolution O is defined, and the pinch roller holder 56 is rollingly movable about the center of revolution O between: the position D that is rotated the angle $\theta 1$ ($\theta 1 \geqq 0$ in the illustrative aspects) from the X-axis toward upstream in the conveying direction; and the position E that is rotated the angle $\theta 2$ ($\theta 2 > \theta 1$) from the X-axis toward upstream in the conveying direction. For explanatory purposes, the centers O, A, and B shown in FIGS. 11 and 12 have been defined in the illustrative aspects, but it should be apparent that the center positions of the drive roller 47, pinch roller 48, and the curved top surface 69 are not limited to these positions.

In this description, an angle formed by line segments OA and OB when the pinch rollers 48 are moved to an arbitrary position will be referred to as θ, where the angle θ may fall within the range θ1≦θ≦θ2. The springs 61 accommodated in the pinch roller holder 56 in a compressed state urge the pinch rollers 48 toward the drive roller 47 (along the line segment AB).

As shown in the drawings, when θ>0, the center O of the arc DE does not match the center A of the drive roller 47 about which the pinch roller 48 moves. Therefore, as θ grows larger, the pinch roller holder 56 gradually separates from the drive roller 47, allowing the springs 61 to extend. Hence, an elastic energy E of the springs 61 decreases as θ grows larger. At this time, a moment M1 acts on the pinch rollers 48 in the counterclockwise direction about the center of rotation A, that is, a direction orthogonal to the line segment AB. The magnitude of the moment M1 is proportional to a decrease dE/dθ in the elastic energy E.

At the same time, a frictional force (frictional moment) M2' is produced in the pinch rollers 48 in the direction opposite this rotational direction about the rotational center B as the pinch rollers 48 follow the rotation of the drive roller 47. Here, M2 is defined as a moment found by converting the frictional force M2' to a force about the center of rotation A, that is, a direction orthogonal to the line segment AB. The frictional force M2' generated at this time is a static frictional force produced on the sliding surfaces of the pinch rollers 48 and rotational shafts 65 as the pinch rollers 48 rotate. The moment M2 is not indicated in FIG. 11.

Further, a rolling frictional force (frictional moment) M3' is generated when the pinch roller holder 56 rolls over the top surface 69 of the holder support member 57. The rolling frictional force M3' acts about the center O, that is, in a direction orthogonal to the line segment OB. M3 is defined as a moment obtained by converting the frictional force M3' to a force about the rotational center A, that is, in a direction orthogonal to the line segment AB. The moment M3 is not shown in FIG. 11.

As shown in FIG. 12, a force W produced by the weight of the recording paper, an elastic force caused by flexing in the recording paper, and the like acts toward the center of the pinch rollers 48 when the drive roller 47 and pinch roller 48 convey the recording paper. This force W generates a moment M4 in a direction where θ becomes smaller. As shown in FIG. 12, since the recording paper is conveyed toward the platen 34 at an angle θ above the platen 34 so as to press the paper against the platen 34, the moment M4 produced by the force W cannot be ignored. In this example, EI signifies the stiffness of the recording paper.

Further, the length of the springs 61 change by a thickness h of the recording paper when the leading edge of the paper becomes interposed between the drive roller 47 and pinch roller 48 or when the trailing edge comes out from the drive roller 47 and pinch roller 48. Specifically, when the leading edge becomes interposed between the drive roller 47 and pinch roller 48, the springs 61 are contracted by the thickness h, and when the trailing edge leaves the drive roller 47 and pinch roller 48, the springs 61 expand by the thickness h. Consequently, the elastic energy of the spring 61 also fluctuates at this time, producing a moment M5 about the rotational center A of a magnitude proportional to dE/dθ, similar to the moment M1 described above.

Since the angle θ (θ1≦θ≦θ2), the thickness h of the recording paper, and the stiffness EI of the recording paper are variables, the moment M1 can be expressed by a function of θ and h, the moment M4 by a function of θ and EI, and the moment M5 as a function of h. While the moments M2 and M3 are also strictly speaking a function of θ and h, these values are much smaller than the moments M1, M4, and M5 and will be treated as constants here. Hereinafter, functions of the angle θ will be expressed as M1(θ) and M4(θ).

In the illustrative aspects, the moments M1 through M5 must satisfy the following equations, assuming that no slippage occurs between the drive roller 47 and pinch roller 48 and that the frictional force between the drive roller 47 and pinch roller 48 and the frictional force between the pinch roller 48 and recording paper are sufficiently large.

Equation (1) applies when the drive roller 47 and pinch roller 48 are not conveying the recording paper. Here, the moment M2 acts in the clockwise direction around the rotational center A, while the moment M3 acts counterclockwise around the rotational center A.

$$M1(\theta)+M3>M2 \tag{1}$$

In this case, the pinch roller holder 56 retracts rearward while rolling upstream in the paper-conveying direction, and is maintained in the retracted position of θ=θ2.

When the recording paper arrives at the nip part between the drive roller 47 and pinch roller 48 and the leading edge of the recording paper is gripped by the rotating drive roller 47, the function of equation (2) below applies. At this time, the moment M3 acts counterclockwise around the rotational center A, while the moment M5 acts clockwise around the rotational center A.

$$M1(\theta)+M3<M4(\theta)+M5 \tag{2}$$

At this time, the pinch roller holder 56 rolls downstream in the paper-conveying direction and is maintained in the conveying position of θ=θ1.

The function in equation (3) below applies when the recording paper is being conveyed. At this time, the moment M2 acts clockwise around the rotational center A, while the moment M3 also acts clockwise around the rotational center A.

$$M1(\theta)<M2+M3+M4(\theta) \tag{3}$$

Hence, the pinch roller holder 56 continues to be maintained in the conveying position of θ=θ1.

When the trailing edge of the recording paper comes out of the nip part between the drive roller 47 and pinch roller 48, the following equation (4) applies. At this time, the moment M3 acts clockwise around the rotational center A, while the moment. M5 acts counterclockwise around the rotational center A, as with the moment M1.

$$M1(\theta)+M5>M3 \tag{4}$$

As can be seen from equation (4), only the moment M3 acts as a frictional force to the moment M1(θ)+M5 produced when the trailing edge of the recording paper leaves the drive roller 47 and pinch roller 48. However, since the M3 is a very slight frictional force produced by the roller bearings 80, the M3 does not act as a force that pushes the recording paper in the conveying direction. Therefore, nearly all of the moment M1(θ)+M5 acts to rotate the pinch roller holder 56 upstream in the paper-conveying direction. Accordingly, the pinch roller holder 56 is retracted and maintained in the retracted position of θ=θ2.

The following equation (5) applies when rotating the drive roller 47 in reverse after the trailing edge of the recording paper has left the drive roller 47 and pinch roller 48, and even during abnormal cases in which the pinch roller holder 56 does not return to the retracted position of θ=θ2, thereby enabling the pinch roller holder 56 to roll to the retracted position of θ=θ2.

$$M1(\theta)+M2>M3 \quad (5)$$

In this case, the moment M2 acts counterclockwise around the rotational center A, and the moment M3 acts clockwise around the center O.

In the multifunction device 1 described above, the pinch roller holder 56 is rollingly supported via the roller bearings 80. By providing the pinch rollers 48, pinch roller holder 56, holder support member 57, springs 61, and the like to satisfy equations (1) through (5), it is possible to reduce the amount of force pushing in the paper-conveying direction to a value approaching zero more easily than a structure employing sliding friction. As a result, the multifunction device 1 can prevent a decline in the quality of images recorded on the recording paper.

While the invention has been described in detail with reference to the above aspects thereof, it would be apparent to those skilled in the art that various changes and modifications may be made therein without departing from the spirit of the invention.

What is claimed is:

1. An image recording apparatus comprising:

a casing;

an image recording unit for recording an image on a recording medium at an image recording position;

a first conveying unit including a drive roller and a follow roller, the first conveying unit conveying the recording medium in a conveying direction toward the image recording position;

a second conveying unit disposed downstream of the image recording position in the conveying direction, the second conveying unit conveying the recording medium farther in the conveying direction;

a first support member supported by the casing;

a second support member rotatably supporting the follow roller;

at least one bearing roller sandwiched between the first support member and the second support member, the at least one bearing roller being supported by the first support member and supporting the second support member; and an urging member that applies an urging force to the follow roller for urging the follow roller toward the drive roller;

wherein the second support member rollingly moves to a first position when the first conveying unit nippingly conveys the recording medium, and the second support member rollingly moves to a second position upstream of the first position in the conveying direction when the recording medium is separated from the first conveying unit.

2. The image recording apparatus according to claim 1;

wherein the second support member has a support part; and wherein the first support member comprises:

a supporting surface that supports the support part of the second support member via the at least one bearing roller;

a first restricting member that restricts rolling of the second support member at the first position; and a second restricting member that restricts rolling of the second support member at the second position.

3. The image recording apparatus according to claim 1;

wherein the at least one bearing roller comprises a plurality of rotary bodies rotatably interposed between the supporting surface of the first support member and the support part of the second support member.

4. The image recording apparatus according to claim 1;

wherein the first support member supports the second support member such that the second support member gradually separates from the drive roller as the second support member rollingly moves from the first position to the second position.

5. The image recording apparatus according to claim 4;

wherein the second support member rollingly moves about a center of revolution parallel to a rotational axis of the drive roller.

6. The image recording apparatus according to claim 5;

wherein an imaginary plane including the rotational axis of the drive roller and the center of revolution is defined; and wherein the second support member is rollingly movable about the center of revolution between: the first position that is rotated a first angle from the imaginary plane toward upstream in the conveying direction; and the second position that is rotated a second angle from the imaginary plane toward upstream in the conveying direction, where the first angle is greater than or equal to zero and the second angle is greater than the first angle.

7. The image recording apparatus according to claim 5;

wherein a supporting surface of the first support member is formed in a shape that substantially conforms to an outer peripheral surface of a predetermined cylindrical path around the center of revolution.

8. The image recording apparatus according to claim 1;

wherein the second support member integrally supports a plurality of follow rollers at predetermined intervals along an axial direction of the drive roller.

9. The image recording apparatus according to claim 1;

wherein a supporting surface of the first support member has an arc shape that slopes downward from an upstream side to a downstream side in the conveying direction.

10. The image recording apparatus according to claim 1;

wherein the at least one bearing roller comprises:

a roller support member; and a plurality of rollers juxtaposed in parallel and rotatably supported by the roller support member.

* * * * *